US007433624B2

(12) United States Patent
Ohkura

(10) Patent No.: US 7,433,624 B2
(45) Date of Patent: Oct. 7, 2008

(54) COOLING STRUCTURE AND IMAGE FORMING APPARATUS PROVIDED WITH THE SAME

(75) Inventor: Yoshimasa Ohkura, Osaka (JP)

(73) Assignee: Kyocera Mita Corporation (JP)

( * ) Notice: Subject to any disclaimer, the term of this patent is extended or adjusted under 35 U.S.C. 154(b) by 357 days.

(21) Appl. No.: 11/342,045

(22) Filed: Jan. 26, 2006

(65) Prior Publication Data

US 2006/0169436 A1 Aug. 3, 2006

(30) Foreign Application Priority Data

Jan. 31, 2005 (JP) ..... 2005-024469

(51) Int. Cl.
*G03G 21/20* (2006.01)

(52) U.S. Cl. ..... 399/92; 399/94

(58) Field of Classification Search ..... 399/92, 399/94, 107, 320

See application file for complete search history.

(56) References Cited

U.S. PATENT DOCUMENTS 5,689,766 A * 11/1997 Hollar et al. ..... 399/92
5,887,226 A * 3/1999 Taki ..... 399/92
5,895,592 A * 4/1999 Struble et al. ..... 399/92 X
6,151,466 A * 11/2000 Fujiwara ..... 399/92
6,275,670 B1 * 8/2001 Cho et al. ..... 399/92
2003/0053818 A1 * 3/2003 Kimura ..... 399/94
2005/0074254 A1 * 4/2005 Maeda ..... 399/92
2005/0074255 A1 * 4/2005 Awaya ..... 399/92
2005/0232653 A1 * 10/2005 Murooka ..... 399/92
2005/0238380 A1 * 10/2005 Iijima et al. ..... 399/92

FOREIGN PATENT DOCUMENTS

JP 2004-138844 5/2004

* cited by examiner

*Primary Examiner*—Sophia S Chen
(74) *Attorney, Agent, or Firm*—Gerald E Hespos; Anthony J. Casella

(57) ABSTRACT

A cooling structure includes driving motors as heat sources, a metal sheet body as a heat transfer member that comes into contact with the driving motors, and a first fan serving as a cooling portion provided oppositely to the metal sheet body in a portion spaced apart from the position at which the driving motors are provided to cool the metal sheet body.

12 Claims, 6 Drawing Sheets

COOLING STRUCTURE AND IMAGE FORMING APPARATUS PROVIDED WITH THE SAME

BACKGROUND OF THE INVENTION

1. Field of the Invention

The present invention relates to a cooling structure that prevents a heat source included in a housing from becoming too hot and thereby prevents heat fatigue of various devices provided adjacently to the heat source, and an image forming apparatus equipped with the cooling structure.

2. Description of the Related Art

An image forming apparatus equipped with a cooling structure as is described in Japanese Unexamined Patent Publication No. 2004-138844 is known in the related art. This image forming apparatus is configured in such a manner that a toner image is obtained by forming an electrostatic latent image on the peripheral surface of the photosensitive drum according to image information and supplying toner to the electrostatic latent image, and after the toner image is transferred onto a sheet of paper, the toner image on the sheet of paper is subjected to fixing processing by heating, after which the sheet of paper is discharged to the outside of the apparatus.

In the image forming apparatus of this kind, a fixing device that applies the fixing processing to the toner image on the sheet of paper by heating becomes a heat source, and the internal temperature of the apparatus main body is increased. A photosensitive unit provided with the photosensitive drum comprising a precision instrument is provided adjacently to the fixing device on the upstream side in the paper transportation direction, and heat transferred from the fixing device to a transfer portion raises a problem that the photosensitive drum is affected adversely by heat distortion or the like.

Such being the case, the image forming apparatus described in Japanese Unexamined Patent Publication No. 2004-138844 cited above adopts a cooling structure formed by providing plural fins in a protruding form to the frame made of synthetic resin and forming the housing of the fixing device, and by covering the fins with a metal foil.

According to this cooling structure, heat generated inside the fixing device is removed efficiently by an air flow that circulates throughout the apparatus via the metal foil covering the fins and having satisfactory heat conductivity. It is thus possible to effectively prevent an event that fixing device becomes so hot that various devices inside the apparatus are adversely affected.

Incidentally, besides the fixing device, a power supply unit that distributes power to various devices installed inside the apparatus main body and driving motors that drive various devices installed inside the apparatus main body are present within the image forming apparatus, and heat released from these heat sources are by no means negligible. The cooling structure described in JP-A-2004-138844 cited above, however, is applicable to the fixing device alone, and has a drawback that the versatility is poor.

This drawback may be overcome by providing fins to the power supply unit and the driving motors and covering these fins with a metal foil. This configuration, however, increases volumes of the power supply unit and the driving motors, which in turn raises a new problem that a limit is imposed in reducing the image forming apparatus in size.

SUMMARY OF THE INVENTION

The invention was devised in view of the foregoing, and therefore has an object to provide a versatile cooling structure that is applicable to various kinds of housing apparatus provided with a heat source that needs cooling and does not constitute a limiting factor in reducing the apparatus in size, and an image forming apparatus equipped with the cooling structure.

The above and other objects of the invention can be achieved by a cooling structure for a housing of the invention, including: a heat source accommodated in the housing; a heat transfer member that is held in an exterior member of the housing and provided in such a manner as to come into contact with or come into close proximity to the heat source; and a cooling portion that is disposed oppositely to the heat transfer member in a portion spaced apart from the heat source to cool the heat transfer member.

According to this configuration, heat released from the heat source is transferred to the heat transfer member held in the exterior member of the housing in such a manner as to come into contact with or come into close proximity to the heat source, and removed by the cooling portion disposed oppositely to the heat transfer member in a portion spaced apart from the heat source. It is thus possible to effectively prevent the heat source from becoming exceedingly hot. Because the cooling portion is provided oppositely to the heat transfer member at a position spaced apart from the heat source, it is possible to provide the cooling portion at the most appropriate position depending on the situation of a housing apparatus to which the cooling structure is applied. This configuration therefore contributes to a reduction of the apparatus that needs cooling in size.

Also, an image forming apparatus of the invention is an image forming apparatus that forms an image on a specific transfer member, including: an apparatus main body of a housing structure that includes a specific device that becomes a heat source; a heat transfer member that is held in an exterior member of the apparatus main body and provided in such a manner as to come into contact with or come into close proximity to the heat source; and a cooling portion that is disposed oppositely to the heat transfer member in a portion spaced apart from the heat source to cool the heat transfer member.

For example, the apparatus main body includes, as the heat source, a power supply unit that distributes power to respective devices in the apparatus main body, driving motors that drive the respective devices, and/or a fixing device that applies fixing processing to a toner image on a sheet of paper having undergone transfer processing, and the heat transfer member is provided in such a manner as to come into contact or come into close proximity to at least one of the heat sources.

According to this configuration, it is possible to provide the cooling portion at the most appropriate position depending on the situation of devices installed within the image forming apparatus. This configuration therefore contributes to a reduction of the image forming apparatus in size.

DETAILED DESCRIPTION OF THE PREFERRED EMBODIMENTS

Figure 1:
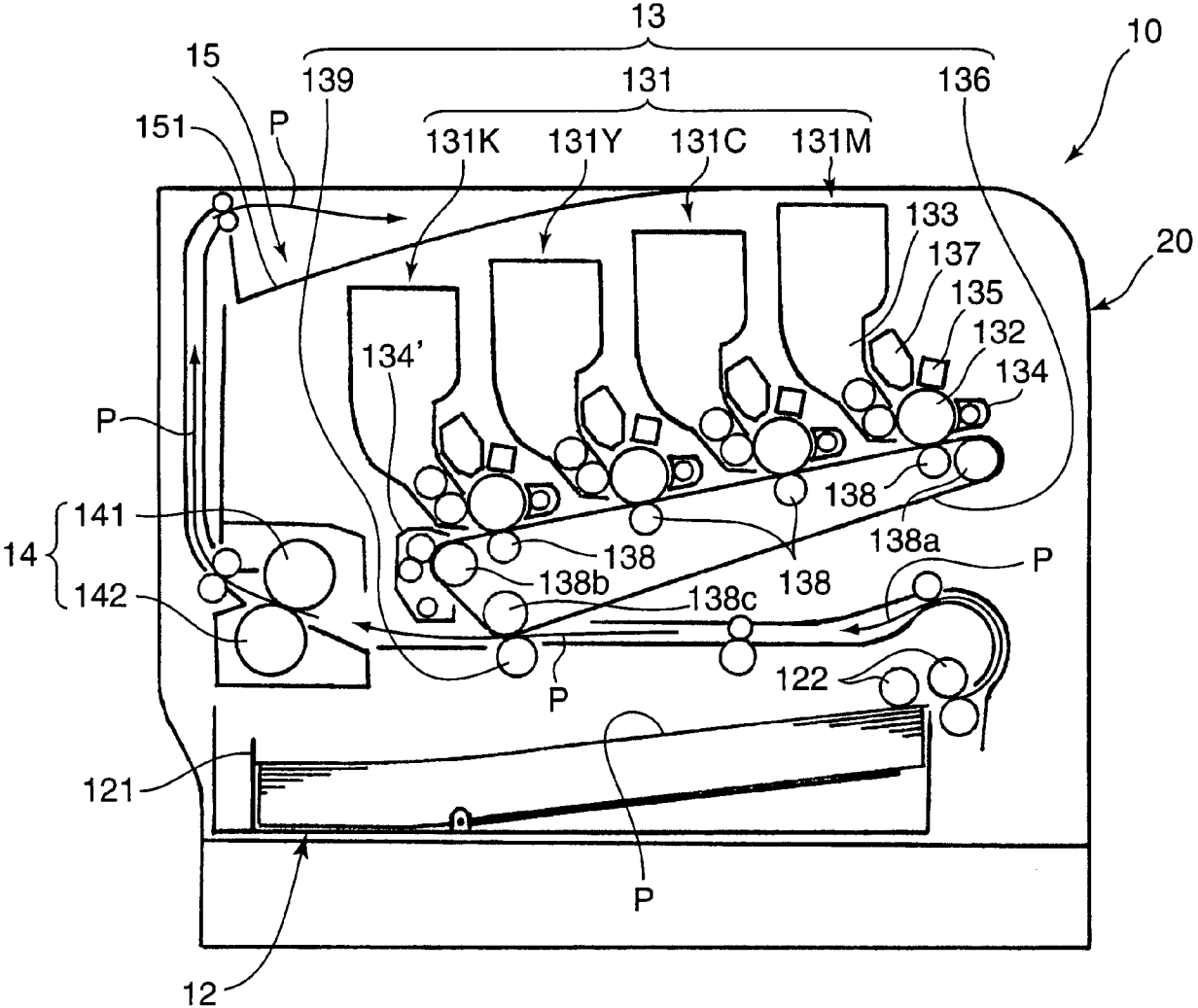
FIG. 1 is a view used to describe an internal structure of an image forming apparatus to which a cooling structure of the invention is applied.

FIG. 1 is a view used to describe an internal structure of an image forming apparatus to which a cooling structure of the invention is applied. FIG. 1 is a cross section taken along the line A-A of FIG. 2 referred to below. As is shown in FIG. 1, an image forming apparatus 10 includes a box-shaped apparatus main body (housing) 20. Installed inside the apparatus main body 20 are a paper feeding portion 12 provided with an attachable/detachable sheet cassette 121 for storing a pile of sheets of paper P, an image transfer portion 13 that transfers an image onto a sheet of paper P by transporting the sheet of paper P fed from the sheet cassette 121 of the paper feeding portion 12, and a fixing portion 14 that applies fixing processing to the image transferred onto the sheet of paper P in the image transfer portion 13. Also, a paper discharge portion 15, onto which the sheet of paper P having undergone the fixing processing in the fixing portion 14 is discharged, is formed on the top surface of the apparatus main body 20.

The paper feeding portion 12 is provided with a pair of pick-up rollers 122 at an upper right position of the sheet cassette 121 of FIG. 1, and sheets of paper P stored in the sheet cassette 121 are picked up one by one by driving the pair of pick-up rollers 122 and fed toward the image transfer portion 13.

The image transfer portion 13 includes an image transfer unit 131, a transfer belt 136 onto which an image is temporarily transferred by the image transfer unit 131, and a second transfer roller 139 that transfers the image, which is temporarily transferred onto the transfer belt 136 by means of a first transfer roller 138, onto a sheet of paper P. In this embodiment, the transfer belt 136 is provided at a position below the image transfer unit 131.

The image transfer unit 131 includes a black unit 131K, a yellow unit 131Y, a cyan unit 131C, and a magenta unit 131M that are provided sequentially from upstream (the left side of the sheet surface of FIG. 1) to downstream. Each of the units 131K, 131Y, 131C, and 131M is attached at the position determined by a specific relative positional relation with respect to respective devices within the apparatus main body 20.

In each of the units 131K, 131Y, 131C, and 131M, a photosensitive drum 132 is provided at the center position, and a developing device 133 is provided on the left side of each photosensitive drum 132 of FIG. 1. Toner is supplied from the developing device 133 to the peripheral surface of the photosensitive drum 132 rotating in a counter-clockwise direction about the center of the drum. A toner image is thus formed on the peripheral surface of the photosensitive drum 132.

A drum-side cleaning device 134 for cleaning that removes residual toner on the peripheral surface of the photosensitive drum 132 is provided at the upper left position of each photosensitive drum 132 of FIG. 1. Also, a charger 135 is provided at a position directly above on the slightly right side of each photosensitive drum 132 of FIG. 1. The peripheral surface of each photosensitive drum 132 having undergone the cleaning processing by the drum-side cleaning device 134 therefore heads toward the charger 135 for new charging processing.

An exposure device 137 is provided at a position directly above on the slightly left side of each photosensitive drum 132. The exposure device 137 irradiates a laser beam according to image data transmitted from another apparatus onto the peripheral surface of the corresponding photosensitive drum 132 that has been charged uniformly by the charger 135. An electrostatic latent image is thus formed on the peripheral surface of the photosensitive drum 132. A toner image is then formed on the peripheral surface of the photosensitive drum 132 as toner is supplied to the electrostatic latent image from the developing device 133. The toner image thus formed is transferred onto the transfer belt 136.

The first transfer roller 138 is provided at a position below each photosensitive drum 132 via the transfer belt 136. Each first transfer roller 138 is supplied with charges having a polarity different from the polarity of charges that the toner image formed on the peripheral surface of the corresponding photosensitive drum 132 has. The toner image formed on the peripheral surface of each photosensitive drum 132 is thus electrostatically attracted onto the surface of the transfer belt 136 in a reliable manner.

As is shown in FIG. 1, the transfer belt 136 is wound around a driving roller 138*a* and a driven roller 138*b* below the respective units 131K, 131Y, 131C, and 131M in such a way that the front surface of the transfer belt 136 comes into contact with the peripheral surface of each photosensitive drum 132. The transfer belt 136 is driven in the specified direction by the driving roller 138*a*. Toner images are superimposedly transferred onto the front surface of the transfer belt 136 from the respective photosensitive drums 132 in synchronization with the movement of the transfer belt 136. The image transfer from one of the photosensitive drums 132 is delayed a specified time from the transfer of another. Consequently, a color transfer image is formed on the front surface of the transfer belt 136 having reached the second transfer roller 139.

The second transfer roller 139 is disposed so that its peripheral surface opposes the surface of the transfer belt 136 at the position of a driven roller 138*c*. The transfer image formed on the surface of the transfer belt 136 is then transferred onto a sheet of paper P while the sheet of paper P fed from the sheet cassette 121 in synchronization with the turning of the transfer belt 136 in the clockwise direction passes through a space between the peripheral surface of the second transfer roller 139 and the surface of the transfer belt 136.

The transfer belt 136 that ends the transfer processing on the sheet of paper P is cleaned through cleaning processing by a belt-side cleaning device 134' that is disposed oppositely to the driven roller 138*b* via the transfer belt 136, and heads to the following toner transfer processing.

The fixing portion 14 applies the fixing processing on the transfer image transferred onto the sheet of paper P in the image transfer portion 13, and includes a heat roller 141 heated by a conducting heating element and a pressure roller 142 that is disposed oppositely to the heat roller 141 and whose peripheral surface is pressed against the peripheral surface of the heat roller 141. The sheet of paper P onto which is transferred the image formed on the surface of the transfer belt 136 by passing through a space between the transfer belt 136 and the second transfer belt 139 undergoes the fixing processing by heating while it passes through a space between the heat roller 141 and the pressure roller 142 for the image to be fixed thereon. The sheet of paper P is then discharged onto a paper discharge tray 151 of the paper discharge portion 15 provided on the top of the apparatus main body 20.

Figure 2:
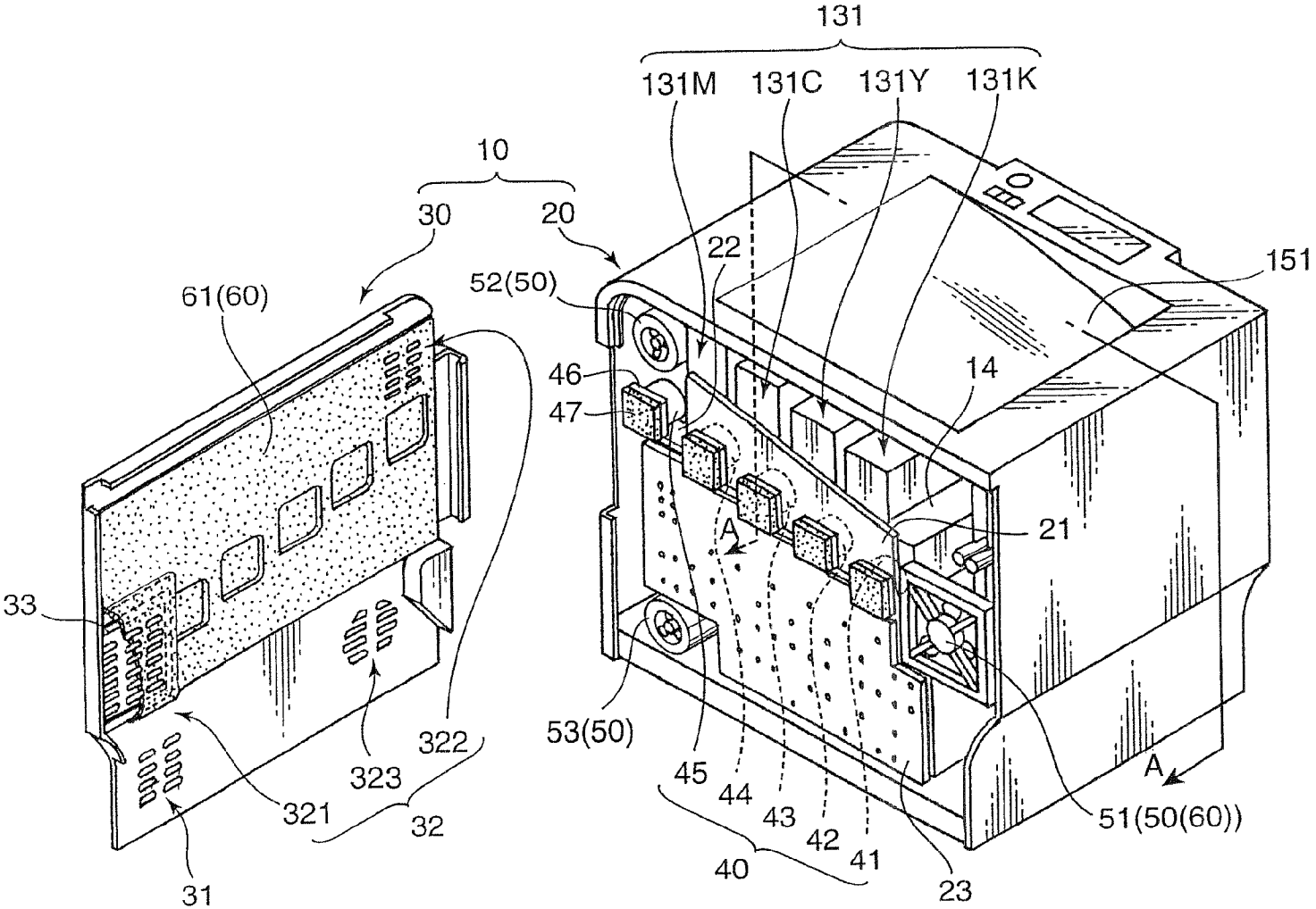
FIG. 2 is a perspective view of the image forming apparatus when viewed from the back surface, showing a state where a lid provided to the apparatus main body on the inner surface side is opened.
Figure 3:
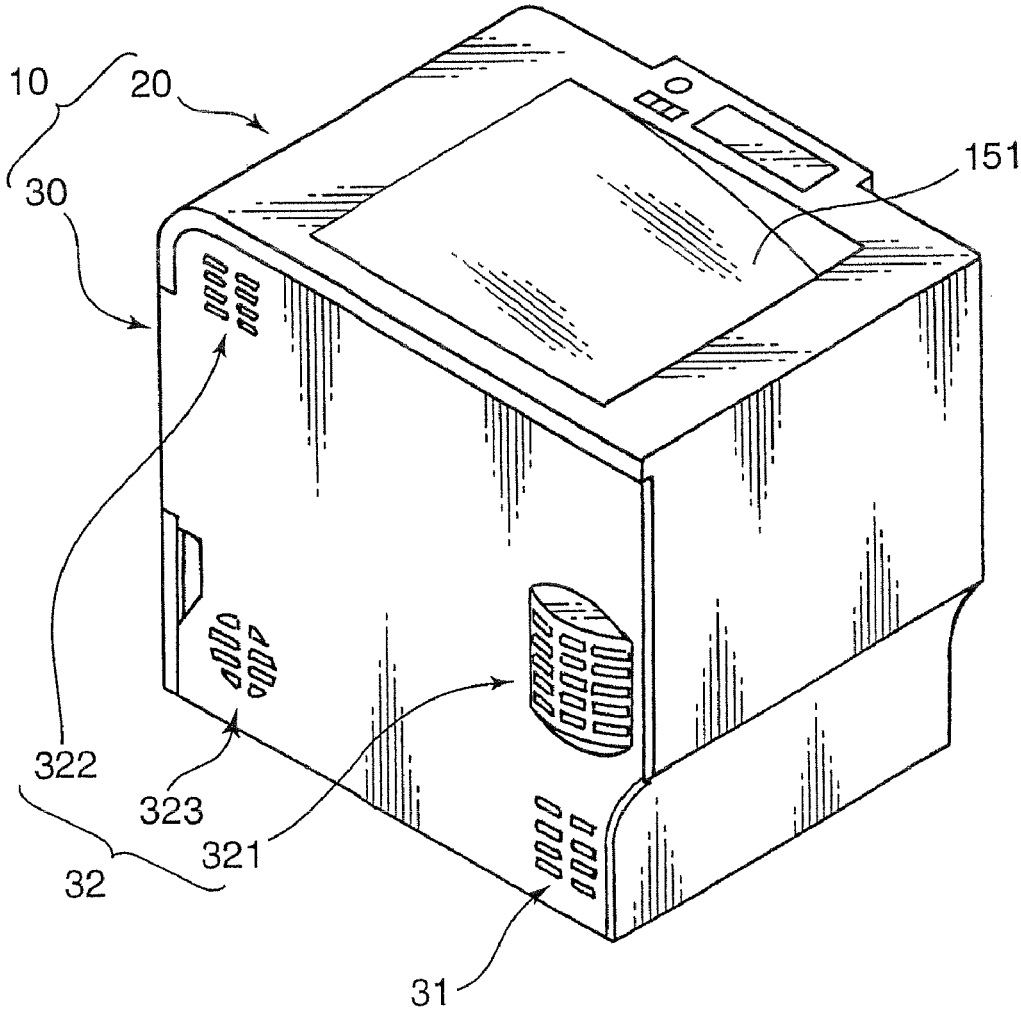
FIG. 3 is a perspective view of the image forming apparatus shown in FIG. 2 when viewed from the back surface, showing a state where the lid is closed.

FIG. 2 and FIG. 3 are perspective views of the image forming apparatus 10 having the internal structure as described above when viewed from the back surface. FIG. 2 shows a state where a lid 30 provided to the apparatus main body 20 on the inner surface side is opened, and FIG. 3 shows a state where the lid 30 is closed. As is shown in FIG. 2, inside the apparatus main body 20, a transfer unit frame 21 that supports the respective units 131K, 131Y, 131C, and 131M is provided slightly above the center position in the vertical direction, and a step-shaped motor supporting frame 22 is provided at a position below the transfer unit frame 21.

A printed board 23 having a step-shaped upper edge portion formed along the step-shaped motor supporting frame 22 is provided below the motor supporting frame 22 on the back surface side. The opening of the apparatus main body 20 on the back surface side is in a state where almost the lower half is covered with the printed board 23.

Major five motors (first through fifth driving motors 41 through 45 aligned from the right side of FIG. 2) among driving motors 40 used in the image forming apparatus 10 are supported on the motor supporting frame 22. A stepping motor capable of precisely controlling the rotational angle is adopted as each of these first through fifth driving motors 41 through 45.

Of these driving motors 40, the first driving motor 41 drives the photosensitive drum 132 of the black unit 131K to rotate about the shaft center, the second driving motor 42 drives the photosensitive drum 132 of the yellow unit 131Y to rotate, the third driving motor 43 drives the photosensitive drum 132 of the cyan unit 131C to rotate, and the fourth driving motor 44 drives the photosensitive drum 132 of the magenta unit 131M to rotate. The fifth driving motor 45 drives the driving roller 138*a* of the transfer belt 136 to rotate.

The first through fourth driving motors 41 through 44 not only drive the photosensitive drums 132 in the respective units 131K, 131Y, 131C, and 131M, but also drive driven members, such as the developing rollers in the developing devices 133 and a collected toner stirring rod in the drum-side cleaning device 134, via unillustrated gear mechanisms.

Plural exhaust fans 50 are provided to appropriate portions within the apparatus main body 20. The interior of the apparatus main body 20 is ventilated by driving these exhaust fans 50, which prevents the interior of the apparatus main body 20 from becoming exceedingly hot. In this embodiment, the exhaust fans 50 include a first fan 51 provided on the right side of the first driving motor 41 of FIG. 2, a second fan 52 provided at a position above the fifth driving motor 45, and a third fan 53 provided in the lower left portion of the apparatus main body 20 of FIG. 2.

The first fan 51 mainly exhausts heated ambient atmosphere in the vicinity of the fixing portion 14. The second fan 52 mainly exhausts heated air collected at the ceiling position inside the apparatus main body 20. The third fan 53 mainly cools the printed board 23, and is disposed to be able to exhaust air that has circulated through the periphery of the printed board 23.

The lid (exterior member) 30 is formed of a flat plate, and is of a shape such that can close the back surface opening of the apparatus main body 20 when fit in this opening. The lid 30 is provided with an inlet portion 31 that introduces air inside the apparatus main body 20, and an exhaust portion 32 that exhausts air inside the apparatus main body 20 to the outside. Each of the inlet portion 31 and the exhaust portion 32 adopts a so-called louver structure comprising plural elongate, open strips extending in the horizontal direction that are provided among plural cross rails.

The inlet portion 31 is provided to the lid 30 directly below a position corresponding to the first fan 51. A space inside the apparatus main body 20 corresponding to the inlet portion 31 is a void. Air introduced inside the apparatus main body 20 from the back surface side via the inlet portion 31 by driving the exhaust fans 50 is circulated around to the front surface side in the apparatus main body 20 and exhausted to the outside via the exhaust portion 32 by driving the first through third fans 51 through 53.

The exhaust portion 32 comprises a first exhaust portion 321 opposing the first fan 51, a second exhaust portion 322 opposing the second fan 52, and a third exhaust portion 323 opposing the third fan 53. Hence, while the lid 30 closes the back surface opening of the apparatus main body 20 as is shown in FIG. 3, air is exhausted via the first exhaust portion 321 by driving the first fan 51, air is exhausted via the second exhaust portion 322 by driving the second fan 52, and air is exhausted via the third exhaust portion 323 by driving the third fan 53.

In the image forming apparatus 10 configured in this manner, the driving motors 40 (first through fifth driving motors 41 through 45) are set as heat sources in this embodiment, and heat generated by these heat sources is removed by a cooling structure 60 of the invention. A square heat sink 46 is provided to the end portion of each of the driving motors 41 through 45 to release heat efficiently.

Figure 4:
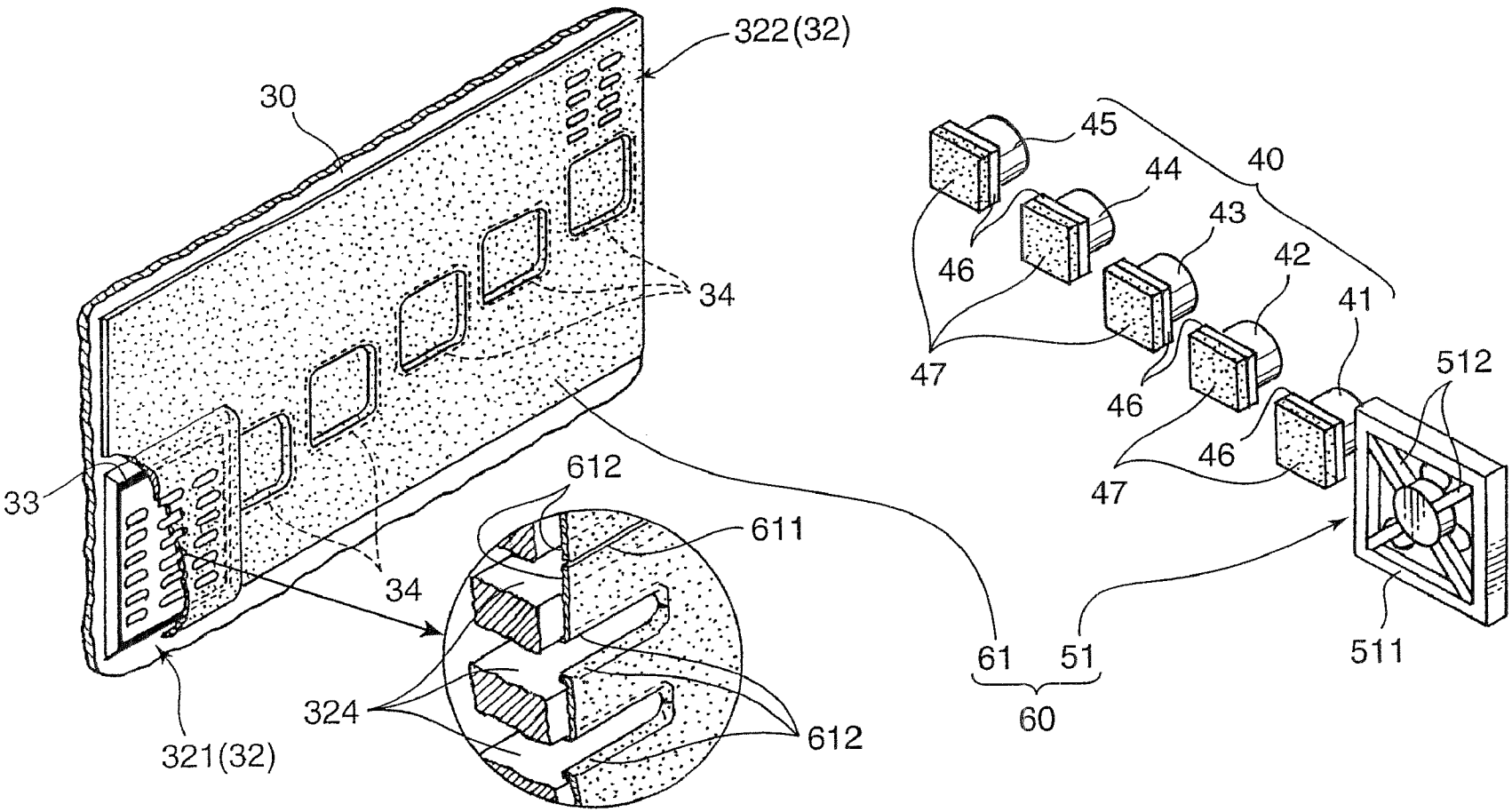
FIG. 4 an exploded perspective view showing one embodiment of the cooling structure.
Figure 5:
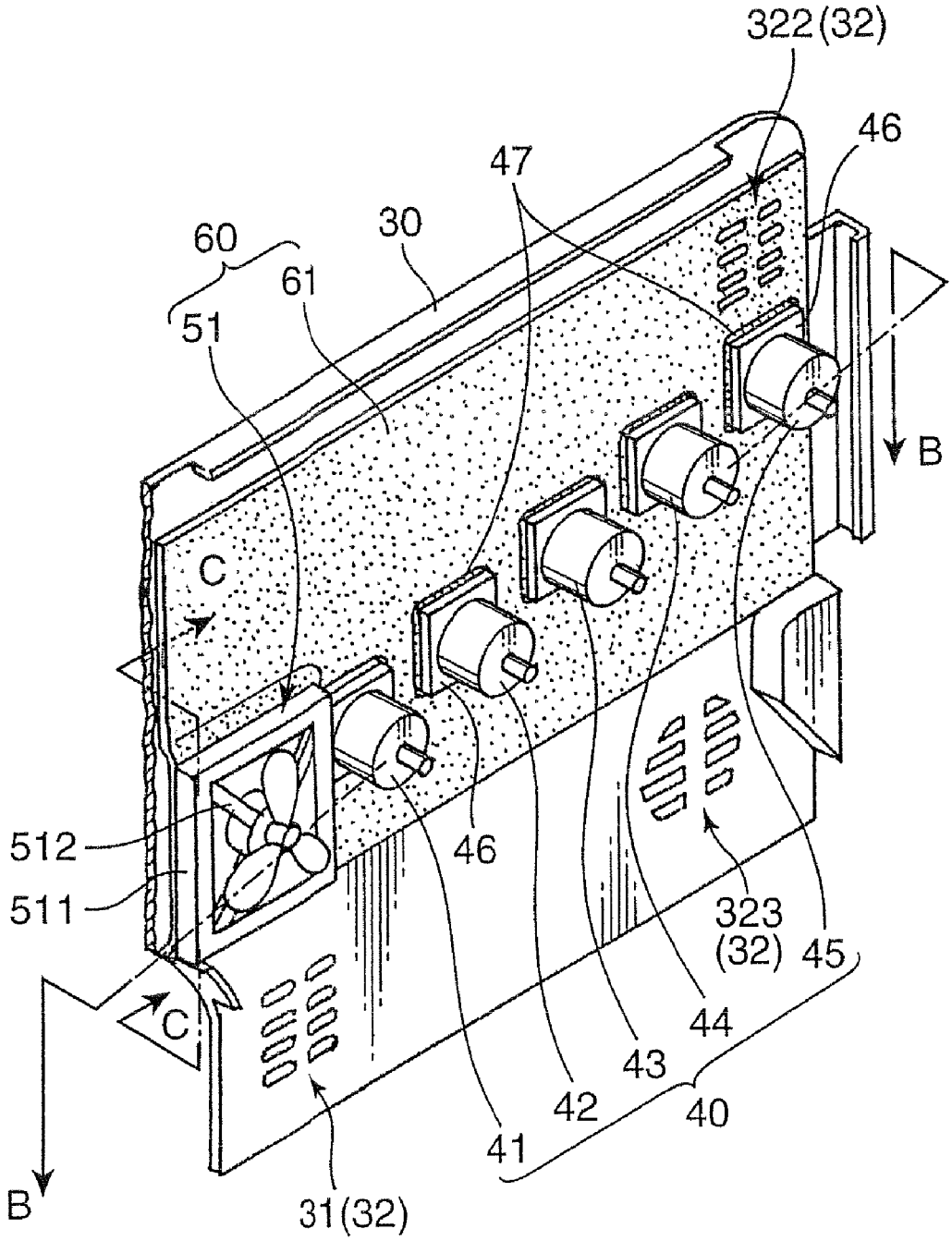
FIG. 5 is a fabricated perspective view of the cooling structure shown in FIG. 4.
Figure 6A:
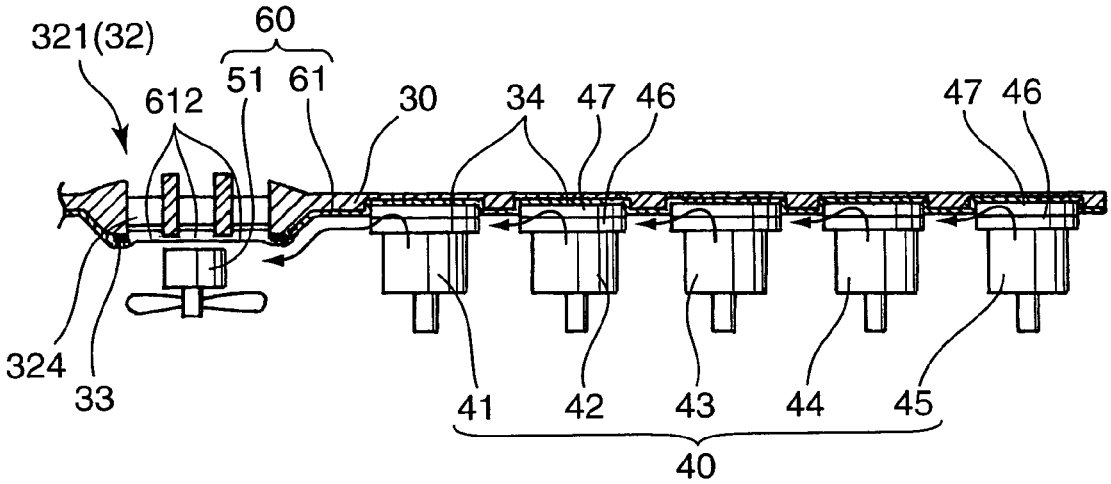
FIG. 6A is a cross section of the lid shown in FIG. 5 taken along the line B-B.
Figure 6B:
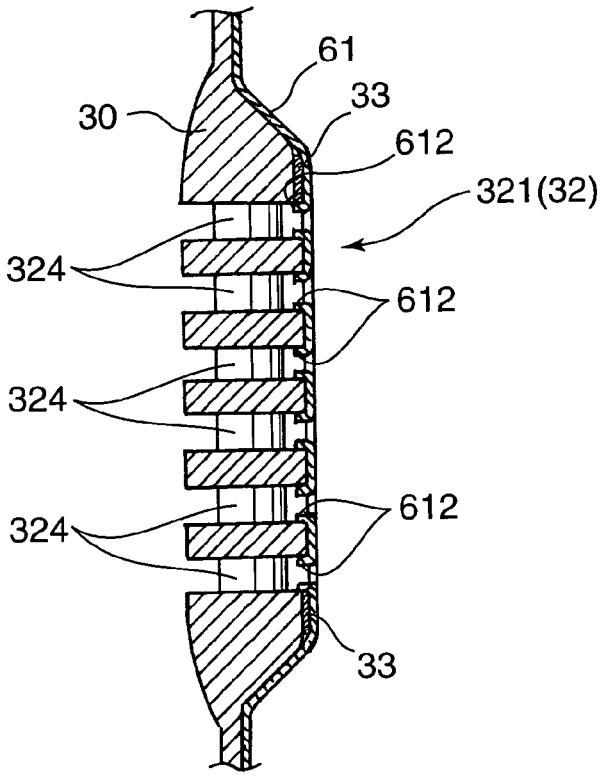
FIG. 6B is a cross section of the lid shown in FIG. 5 taken along the line C-C.

FIG. 4 and FIG. 5 are perspective view showing one embodiment of the cooling structure 60. FIG. 4 is an exploded perspective view and FIG. 5 is a fabricated perspective view. The inset inside a circle of FIG. 4 is an enlarged view of a partially notched portion of the first exhaust portion 321. FIG. 6A and FIG. 6B are cross sections of the lid 30 shown in FIG. 5 taken along the line B-B and along the line C-C, respectively.

As is shown in FIG. 4, the cooling structure 60 comprises a metal sheet body (heat transfer member) 61 that comes into contact with the heat sources (in this embodiment, the driving motors 40 (first through fifth driving motors 41 through 45)), and the first fan (cooling portion) 51.

In this embodiment, an aluminum foil is adopted as the metal sheet body 61, and it is mounted on the lid 30 on the back surface side in a planar shape of a size large enough to cover the first through fifth driving motors 41 through 45. In this embodiment, the metal sheet body 61 is made in a rectangular shape of a size large enough to cover the first exhaust portion 321 and covers almost the upper half of the lid 30.

Meanwhile, the first exhaust portion 321 adopting the louver structure is provided with long holes 324 elongated in the horizontal direction and aligned in three columns in the vertical direction, and cuttings 611 (see the inset inside the circle of FIG. 4) made in the metal sheet body 61 at portions opposing the respective long holes 324 and extending in the horizontal direction along the center lines of the respective long holes 324 in their elongate direction.

A pair of folding pieces 612 on top and bottom in reference to each cutting 611 is thus formed in the metal sheet body 61 for each long hole 324 in a portion corresponding to each long hole 324. These folding pieces 612 are folded inside the long holes 324 and mounted on the edge surfaces on the top and bottom of the long holes 324. When configured in this manner, a contact area of the metal sheet body 61 for air sent by the first fan 51 is increased in comparison with a case where holes of a shape matching with the long holes 324 are punched. A significant cooling effect can be thus achieved.

An annular sealing member 33 made of an elastic material, such as rubber, is mounted onto the first exhaust portion 321 to surround all the long holes 324, and the annular sealing member 33 comes into contact with on an annular frame body 511 that supports the first fan 51 via a specific number of diagonal bracing members 512 while the lid 30 closes the back surface opening of the apparatus main body 20. The presence of the annular sealing member 33 allows a whole amount of exhaust air by the first fan 51 to pass through the first exhaust portion 321 in a reliable manner.

The lid 30 is provided with concave portions 34 at portions corresponding to the respective driving motors 41 through 45. The end portions of the respective driving motors 41 through 45 are fit in the corresponding concave portions 34 via the metal sheet body 61 while the lid 30 is closed. Incidentally, providing the concave portions 34 contributes to a reduction of the image forming apparatus 10 in size.

In this embodiment, on the square heat sink 46 formed on the end face of each of the driving motors 41 through 45, a heat releasing member 47 of the identical shape is fixedly layered. In this embodiment, a plate body made of aluminum alloy of a specific thickness is adopted as the heat releasing member 47. The heat releasing member 47 is adopted to secure reliable adhesion of the heat sink 46 to the metal sheet body 61 via the heat releasing member 47 while the lid 30 is attached to the apparatus main body 20.

The heat releasing member 47 is of a thickness at which the metal sheet body 61 undergoes elastic deformation slightly toward the back surface side to bulge slightly while the lid 30 is attached to the apparatus main body 20. When configured in this manner, because the metal sheet body 61 presses the heat sinks 46 of the respective driving motors 41 through 45 via the heat releasing members 47, heat is transferred from the respective driving motors 41 through 45 toward the metal sheet body 61 in a reliable manner.

According to the cooling structure 60 configured as described above, the respective driving motors 41 through 45 come into contact with the metal sheet body 61 mounted on the lid 30 on the back surface side via the heat sinks 46 and the heat releasing members 47 as is shown in FIG. 6A while the lid 30 closes the opening of the apparatus main body 20 as is shown in FIG. 3. Heat generated by driving the respective driving motors 41 through 45 is thus transferred to the metal sheet body 61 via the heat sinks 46 and the heat releasing members 47 as is indicated by a solid arrow in FIG. 6A, and spreads toward the front surface of the wide metal sheet body 61.

For the potion of the metal sheet body 61 corresponding to the first exhaust portion 321, because the folding pieces 612 formed correspondingly to the respective long holes 324 are folded toward the long holes 324 and a heat transfer area is increased in comparison with a case where the metal sheet body 61 is merely punched, heat transferred to the respective folding pieces 612 is cooled efficiently in these portions.

A temperature gradient of the metal sheet body 61 between portions corresponding to the respective driving motors 41 through 45 and a portion corresponding to the first exhaust portion 321 therefore becomes steeper. Consequently, heat is transferred efficiently from the respective driving motors 41 through 45 as the heat sources to the first exhaust portion 321, which can in turn cool the respective driving motors 41 through 45 in a reliable manner.

In addition, because the metal sheet body 61 has quite a large area, heat spread across the metal heat sheet body 61 is cooled also by an air flow circulating inside the apparatus main body 20, which is of some help in improving the cooling effect.

Incidentally, part of the metal sheet body 61 is fit in the long holes 324 in the first exhaust portion 321 to form the plural folding pieces 612, and these folding pieces 612 are provided to align in the vertical direction as is shown in FIG. 6B. This state falls into the concept of a corrugated shape in the invention.

As has been described in detail, the cooling structure 60 of the invention comprises the heat transfer member (the metal sheet body 61 in this embodiment) that comes into contact with the heat sources (the driving motors 40 in this embodiment), and a cooling portion (the first fan 51 in this embodiment) that cools the heat transfer member and is disposed oppositely to the heat transfer member at a portion spaced apart from the heat sources. Heat released from the heat sources is therefore transferred to the heat transfer member that comes into contact with the heat sources, and removed by the cooling portion disposed oppositely to the heat transfer member at a portion spaced apart from the heat sources. It is thus possible to prevent effectively the heat sources from becoming exceedingly hot.

Because the cooling portion is provided oppositely to the heat transfer member at a position spaced apart from the heat sources, it is possible to provide the cooling portion at the most appropriate position depending on the situation of an apparatus to which the cooling structure is applied. The cooling structure therefore contributes to a reduction of a subject apparatus (the image forming apparatus 10 in this embodiment) in size.

In a case where plural heat sources are present inside the subject apparatus, by making the heat transfer member in a large planar shape of a size large enough to cover the respective heat sources, it is possible to achieve a versatile cooling structure that can be applied to the cooling processing for heat sources of any kind.

In this embodiment, because a sheet of the metal sheet body 61 is adopted as the heat transfer member, the heat conductivity of the metal sheet body 61 is higher than that made of non-metal, and is therefore used suitably as a member that plays a role of releasing heat of the heat sources.

Also, because the first fan 51 that blows a cooling air flow to the folding pieces 612 of the metal sheet body 61 is adopted as the cooling portion, an air flow is developed by driving the first fan 51. Hence, by supplying the air flow thus developed to the folding pieces 612 of the metal sheet body 61, the air flow removes heat from the metal sheet body 61. It is thus possible to cool the driving motors 40 as the heat sources efficiently via the metal sheet body 61.

In the embodiment above, because the metal sheet body 61 is mounted onto the inner wall surface of the lied 30, the metal sheet body 61 does not occupy a space inside the apparatus main body 20. This configuration can therefore contribute to a reduction of the image forming apparatus 10 in size.

The plural concave portions 34 are made in the inner wall surface of the lid 30 for the end portions of the first through fifth driving motors 41 through 45 to be fit therein, and part of the metal sheet body 61 is sandwiched between the first through fifth driving motors 41 through 45 and the inner wall surface of the lid 30 within the respective concave portions 34. This configuration makes it possible to increase an accommodation volume for the respective driving motors 41 through 45 in the apparatus main body 20, and thereby contributes to a reduction of the image forming apparatus 10 in size.

In the embodiment above, because the first exhaust portion 321 is provided to the lid 30 to which the first fan 51 opposes, heat removed from the metal sheet body 61 by the first fan 51 can be released to the outside via the first exhaust portion 321. The cooling effect can be thus improved.

It should be appreciated that the invention is not limited to the embodiment above, and includes the contents as follows.

In the embodiment above, the cooling structure 60 of the invention is applied to the image forming apparatus 10. In the invention, however, the application of the cooling structure 60 is not limited to the image forming apparatus 10, and the cooling structure 60 can be applied to various electric apparatuses (for example, a TV receiver, a personal computer, a hard disc device, etc.) in which a heat source is present inside the apparatus main body.

In the embodiment above, the image forming apparatus 10 of the so-called electrophotographic method was described by way of example. However, the invention can be applied, for example, to an image forming apparatus of the ink jet method. In the printer or the like adopting the ink jet method, heat sources like the fixing device are absent. However, an ink head provided with an array of ink nozzles is used, and an ink ejection heat source is provided for each nozzle, or the ink head per se is pre-heated to a temperature just below the ejection temperature. The ink head therefore becomes a heat source, and the invention can be applied to cool the ink head.

In the embodiment above, the driving motors 40 were described as the heat sources. In the invention, however, the heat source is not limited to the driving motors 40. The heat source can be a certain power supply unit or the fixing portion 14 provided with the heat roller 141 installed inside the apparatus main body 20. In particular, because high-temperature heat is generated in the fixing portion 14, the cooling structure 60 of the invention functions effectively, and contributes to the cooling processing for the fixing portion 14. In a case where a laser scanner is provided to the image forming apparatus, a polygon motor used in the laser scanner can be a subject to be cooled by the invention. In a case where a storage device, such as a hard disc device, is incorporated in the apparatus, the storage device can be a subject to be cooled by the invention.

In the embodiment above, an aluminum foil is adopted as the metal sheet body 61. In the invention, however, the metal sheet body 61 is not limited to an aluminum foil, and a sheet body made of metal other than aluminum, such as copper or iron, may be adopted instead.

In the embodiment above, plate members made of aluminum alloy are adopted as the heat releasing members 47 provided to the heat sinks 46 of the driving motors 40. However, a plate member made of metal other than aluminum alloy may be adopted, or an aluminum foil folded in several steps may be adopted instead.

In the embodiment above, the plural folding pieces 612 arrayed in parallel are used as a corrugated shape of the invention formed in the metal sheet body 61. However, instead of this configuration, a corrugate shape may be formed in the metal sheet body 61 in a portion where the folding pieces 612 are not formed. When configured in this manner, because the surface area of the metal sheet body 61 is increased, the cooling effect of the metal sheet body 61 can be improved.

In the embodiment above, the metal sheet body 61 is mounted onto the inner wall surface of the lid 30. However, the metal sheet body 61 may be mounted onto the inner wall surface of the apparatus main body 20 instead.

In the embodiment above, the exhaust fan 50 (the first fan 51 in the embodiment above) is adopted as the cooling portion. In the invention, however, the cooling portion is not limited to the cooling fan 50, and it may be a cooling medium, such as cooling water. For example, when cooling water is adopted as the cooling portion, part of the metal sheet body 61 is dipped in the cooling water. When configured in this manner, heat transferred from the heat source to the metal sheet body 61 is cooled by the cooling water.

In the embodiment above, the driving motors 40 as the heat sources come into contact with the metal sheet body 61. In the invention, however, the heat sources do not necessarily come into contact with the metal sheet body 61. The heat sources may be brought into close proximity to the metal sheet body 61 depending on the situation. In this case, heat of the heat sources is transferred to the metal sheet body 61 by means of heat radiation.

This application is based on patent application No. 2005-024469 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A cooling structure for a housing, the housing having at least one exterior member with an inwardly facing surface, the cooling structure comprising:

a heat source accommodated in the housing;

a heat transfer member that is held substantially adjacent the inwardly facing surface of the exterior member of the housing and provided in such a manner as to come into contact with or come into proximity to the heat source; and a cooling portion that is disposed oppositely to the heat transfer member in a portion spaced apart from the heat source to cool the heat transfer member.

2. The cooling structure according to claim 1, wherein:

the heat transfer member is made of a sheet of a metal sheet body.

3. The cooling structure according to claim 2, wherein:

a portion of the metal sheet body opposing the cooling portion is made in a corrugated shape.

4. The cooling structure according to claim 1, wherein:

the cooling portion is provided with a fan that blows a cooling air flow to the heat transfer member.

5. An image forming apparatus that forms an image on a specific transfer member, comprising:

an apparatus main body that includes at least one exterior member having an exterior surface facing outwardly on the image forming apparatus and an inner wall surface facing inwardly into the image forming apparatus, at least one heat source in the image forming apparatus;

a heat transfer member that disposed substantially adjacent the interior surface of the exterior member of the apparatus main body and provided in such a manner as to come into contact with or come into proximity to the heat source; and a cooling portion that is disposed oppositely to the heat transfer member in a portion spaced apart from the heat source to cool the heat transfer member.

6. The image forming apparatus according to claim 5, wherein:

the at least one heat source includes a power supply unit that distributes power to respective devices in the apparatus main body, driving motors that drive the respective devices, and/or a fixing device that applies fixing processing to a toner image on a sheet of paper having undergone transfer processing; and the heat transfer member is provided in such a manner as to come into contact with or come into proximity to at least one of the heat sources.

7. The image forming apparatus according to claim 5, wherein:

a ventilation hole is provided in part of the inner wall surface to which the cooling portion opposes.

8. The image forming apparatus according to claim 7 wherein the heat transfer member is bent to extend into the ventilation hole.

9. The image forming apparatus according to claim 5, wherein:

the heat transfer member is made of a sheet of a metal sheet body.

10. The image forming apparatus according to claim 9, wherein:

a portion of the metal sheet body opposing the cooling portion is made in a corrugated shape.

11. The image forming apparatus according to claim 5, wherein:

the cooling portion is provided with a fan that blows a cooling air flow to the heat transfer member.

12. An image forming apparatus that forms an image on a specific transfer member, comprising:

an apparatus main body that includes at least one exterior member having an exterior surface facing outwardly on the image forming apparatus and an inner wall surface facing inwardly into the image forming apparatus, at least one heat source in the image forming apparatus;

a heat transfer member mounted onto the inner wall surface of the exterior member of the apparatus main body and provided in such a manner as to come into contact with or come into proximity to the heat source, the inner wall surface is provided with a concave portion in which part of the heat source is fit, and part of the heat transfer member is sandwiched between the heat source and the inner wall surface within the concave portion; and a cooling portion that is disposed oppositely to the heat transfer member in a portion spaced apart from the heat source to cool the heat transfer member.

* * * * *